US010459470B2

(12) United States Patent
Jefremow et al.

(10) Patent No.: US 10,459,470 B2
(45) Date of Patent: Oct. 29, 2019

(54) VOLTAGE REGULATOR AND METHOD FOR PROVIDING AN OUTPUT VOLTAGE WITH REDUCED VOLTAGE RIPPLE

(71) Applicant: Dialog Semiconductor (UK) Limited, London (GB)

(72) Inventors: Mihail Jefremow, Augsburg (DE); Dan Ciomaga, Ingolstadt (DE); Gennadii Tatarchenkov, Munich (DE); Stephan Drebinger, Munich (DE); Fabio Rigoni, Karlsfeld (DE); Alessandro Angeli, Munich (DE); Petrus Hendrikus Seesink, Ouddorp (NL)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/977,013

(22) Filed: May 11, 2018

(65) Prior Publication Data

US 2018/0329440 A1 Nov. 15, 2018

(30) Foreign Application Priority Data

May 11, 2017 (DE) ..... 10 2017 207 998

(51) Int. Cl.
*G05F 1/575* (2006.01)
*G05F 1/56* (2006.01)
(Continued)

(52) U.S. Cl.
CPC ..... *G05F 1/575* (2013.01); *G05F 1/56* (2013.01); *G05F 1/563* (2013.01); *G05F 1/59* (2013.01)

(58) Field of Classification Search
CPC . G05F 1/56; G05F 1/563; G05F 1/565; G05F 1/575; G05F 1/614
See application file for complete search history.

(56) References Cited

U.S. PATENT DOCUMENTS 6,563,294 B2 * 5/2003 Duffy ..... H02J 1/102 323/283
7,061,215 B2 * 6/2006 Harris ..... H02J 1/102 323/268
(Continued)

FOREIGN PATENT DOCUMENTS

DE 10 2010 002 528 9/2010
DE 10 2014 102 860 9/2014
(Continued)

OTHER PUBLICATIONS

German Office Action, File No. 10 2017 207 998.3, Applicant: Dialog Semiconductor (UK) Limited, dated Dec. 20, 2017, 8 pgs, and English language translation, 10 pgs.
(Continued)

*Primary Examiner* — Matthew V Nguyen
(74) *Attorney, Agent, or Firm* — Saile Ackerman LLC; Stephen B. Ackerman

(57) ABSTRACT

A digital voltage regulator and a method to regulate an output voltage at an output node based on an input voltage is presented. The regulator has a driver stage with N driver slices, with N>1. Each of the N driver slices can be activated or deactivated individually. A driver slice comprises a current source to provide an output current component to the output node, if the driver slice is activated. Furthermore, the regulator has a control unit to activate a number n of the N driver slices, based on a deviation of a feedback voltage from a reference voltage, where the feedback voltage is dependent on the output voltage.

26 Claims, 7 Drawing Sheets

(51) Int. Cl.
*G05F 1/59* (2006.01)
*G05F 1/563* (2006.01)

(56) References Cited

U.S. PATENT DOCUMENTS

| | | | | |
|---|---|---|---|---|
| 7,161,423 | B2 * | 1/2007 | Paul | H03F 1/0205 330/251 |
| 7,218,168 | B1 | 5/2007 | Rahman | |
| 8,536,844 | B1 | 9/2013 | Kumar et al. | |
| 2002/0118001 | A1 * | 8/2002 | Duffy | H02J 1/102 323/283 |
| 2008/0157740 | A1 | 7/2008 | Gurcan | |
| 2011/0089916 | A1 | 4/2011 | Soenen et al. | |
| 2013/0057240 | A1 * | 3/2013 | Zambetti | H02M 3/156 323/271 |
| 2014/0253072 | A1 | 9/2014 | Hussien et al. | |
| 2014/0266103 | A1 | 9/2014 | Wang et al. | |
| 2015/0177757 | A1 | 6/2015 | Bhattad et al. | |
| 2016/0124454 | A1 | 5/2016 | Chellappa | |
| 2016/0154415 | A1 | 6/2016 | Biziitu et al. | |

FOREIGN PATENT DOCUMENTS

| | | |
|---|---|---|
| DE | 10 2014 019 355 | 6/2015 |
| WO | WO 2015/094252 | 6/2015 |

OTHER PUBLICATIONS

"A 100-mA, 99.11% Current Efficiency, 2-mVpp Ripple Digitally Controlled LDO With Active Ripple Suppression," by Michael Cheah et al., IEEE Transactions on Very Large Scale Integration (VLSI) Systems, vol. 25, No. 2, Feb. 2017, pp. 696-704.

0.5-V Input Digital LDO with 98.7% Current Efficiency and 3.7-μA Quiescent Current in 65nm CMOS, by Yasuyuki Okuma et al. IEEE Custom Integrated Circuits Conference 2010, Sep. 19-22, 2010, 4 pages.

* cited by examiner

VOLTAGE REGULATOR AND METHOD FOR PROVIDING AN OUTPUT VOLTAGE WITH REDUCED VOLTAGE RIPPLE

TECHNICAL FIELD

The present document relates to voltage regulators. In particular, the present document relates to a digital voltage regulator which is configured to provide an output voltage with a reduced voltage ripple.

BACKGROUND

Power management integrated circuits (ICs) typically incorporate one or more voltage regulators, notably low dropout regulators (LDOs), to provide one or more stable and accurately regulated supply rails. Due to the reduction of transistor dimensions, the demand for integrating an increased amount of analog functions into a digital circuit, e.g. by using minimum length devices, becomes more attractive.

The functionality of an LDO may be implemented using a digital controller with synchronous or asynchronous logic followed by a driver stage. The control portion of the LDO may be implemented in a fully digital manner and may efficiently be ported to different technologies without taking into account analog considerations such as bias generation, coupling or special layout techniques.

SUMMARY

The present document addresses the technical problem of provide a digitally controlled voltage regulator providing an output voltage with a reduced ripple. According to an aspect, a digital voltage regulator configured to regulate an output voltage at an output node based on an input voltage is described. The regulator comprises a driver stage comprising N driver slices, with N>1, wherein each of the N driver slices is configured to be activated or deactivated individually. At least one of the N driver slices comprises a current source configured to provide an output current component to the output node, if the driver slice is activated. Furthermore, the voltage regulator comprises a control unit configured to activate a number n of the N driver slices, based on a deviation of a feedback voltage from a reference voltage, wherein the feedback voltage is dependent on the output voltage.

According to another aspect, a method for regulating an output voltage at an output node based on an input voltage is described. The method comprises providing a driver stage comprising N driver slices, with N>1, wherein each of the N driver slices can be activated or deactivated individually. A driver slice comprises a current source configured to provide an output current component to the output node, if the driver slice is activated. Furthermore, the method comprises activating a number n of the N driver slices, based on a deviation of a feedback voltage from a reference voltage, wherein the feedback voltage is dependent on the output voltage.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
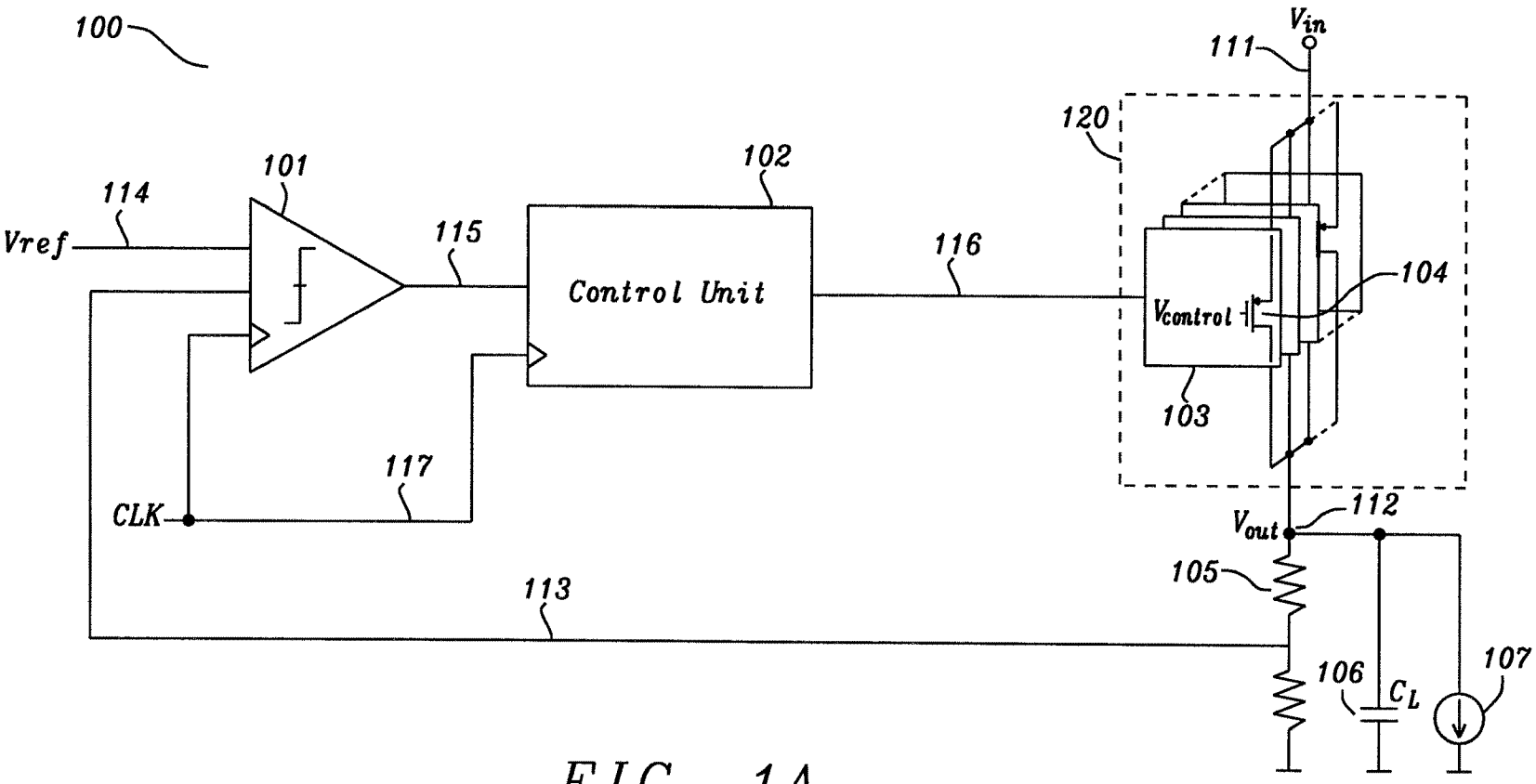
FIG. 1A illustrates an example digital voltage regulator.

FIG. 1A shows an example digital voltage regulator 100, notably a digital LDO. The regulator 100 comprises a plurality of driver slices 103, wherein each driver slice 103 comprises one or more pass switches or pass transistors 104. A driver slice 103 may either be activated or deactivated, in a digital manner. The pass switch 104 of an activated driver slice 103 is closed and the pass switch 104 of a deactivated driver slice 103 is open. Hence, the pass switches or pass transistors 104 are controlled in a digital manner, being either closed or open.

Each pass switch 104 may provide a (typically fixed or constant) output current component. As a result of this, the total output current which is provided at the output node of the regulator 100 may be set by selecting a certain number n of activated driver slices 103. By way of example, the regulator 100 may comprise N driver slices 103, wherein each driver slice 103 may provide an output current component $I_C$. In case n of the N driver slices are activated, the total output current $I_O$ of the regulator is $I_O=n*I_C$.

The set of driver slices 103 is configured to couple the input voltage $V_{IN}$ 111 with the output voltage $V_{OUT}$ 112. Using a voltage divider 105, a feedback voltage 113 may be derived from the output voltage 112, wherein the feedback voltage 113 is proportional to the output voltage 112. Using a comparator 101, the feedback voltage 113 is compared to a reference voltage $V_{ref}$ 114, thereby providing a digital comparator signal 115, which indicates whether the feedback voltage 113 is greater or smaller than the reference voltage 114. A (digital) controller or control unit 102 may determine the number n of slices 103 that should be activated, based on the comparator signal 115. In particular, the controller 102 may generate a control signal 116 comprising e.g. N bits for controlling the N slices 103. The N bits of the control signal 116 may indicate for each slice 103 whether the slice 103 should be activated or deactivated.

The generation of the control signal 116 may be triggered using a clock signal CLK 117. Hence, the control signal 116 may be updated at a certain update frequency, which may be in the range of 100 kHz or more. Furthermore, FIG. 1A shows an output capacitor 106 of the regulator 100 as well as a load 107 which is coupled to the regulator 100.

Hence, the digital control 102 may receive a one bit comparator signal 115 from a clocked comparator 101. The comparator 101 compares the reference voltage $V_{ref}$ 114 with the divided down output voltage $V_{out}$ 112 and gives either '1' or '0' as comparator signal 115 for the digital controller 102. The controller 102 may be implemented as a so called barrel shifter, which has an N bit output signal 116 for the N slices 103. The N bit digital word 116 controls the driver stage 120, consisting of N driver slices 103, wherein each of the driver slices 103 is connected to the corresponding one bit of the digital control vector 116. This approach for a driver stage 120 may be used, if the input voltage $V_{in}$ 111 is constant and/or if the difference between $V_{in}$ 111 and $V_{out}$ 112 is relatively low.

Figure 1B:
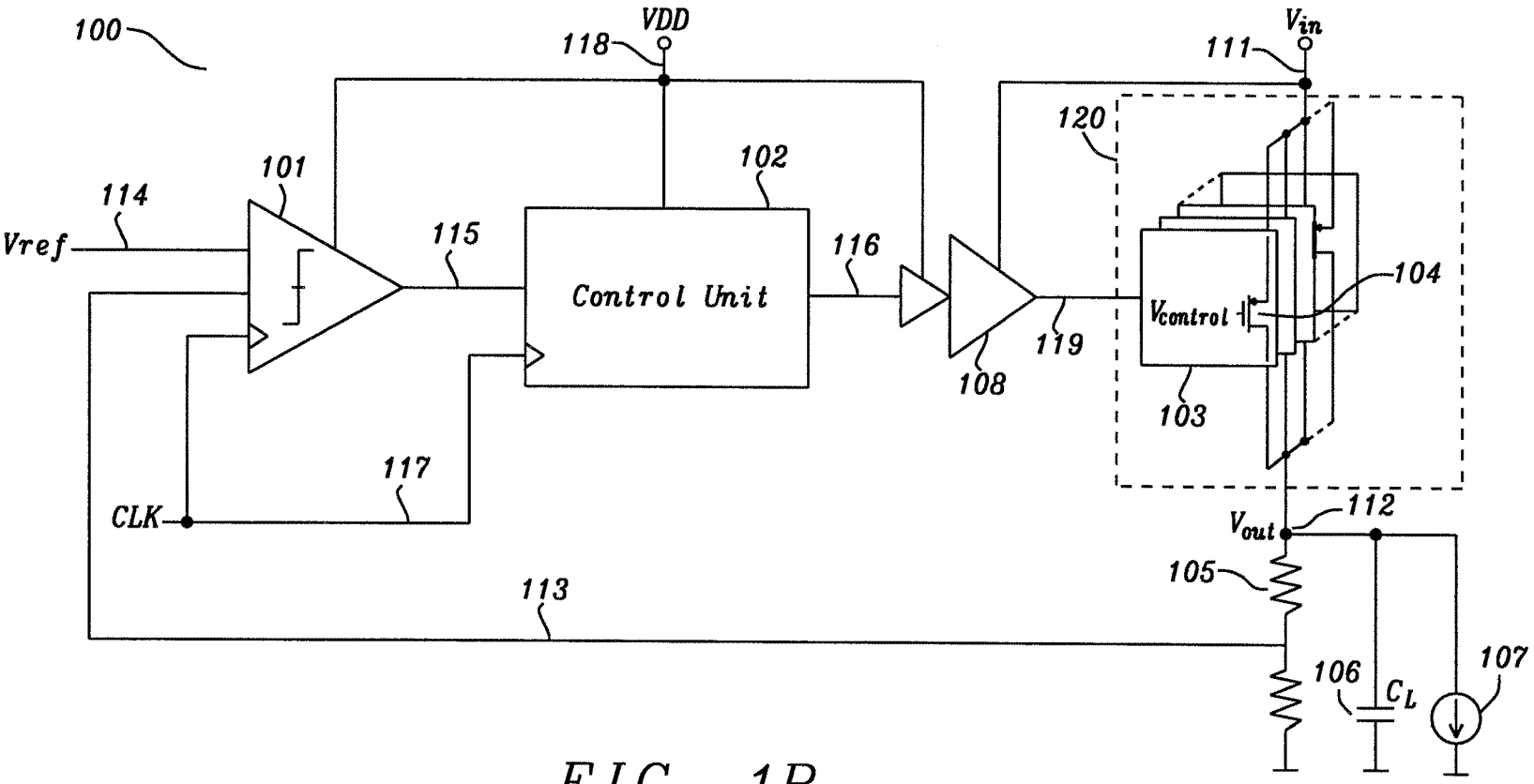
FIG. 1B illustrates an example digital voltage regulator with level shifter circuitry.

In case $V_{in}$ 111 is higher than the digital supply voltage VDD 118 which supplies the digital controller 102, additional level-shifter circuitry 108 may be used to provide a level shifted (N bit) control signal 119 (as shown in FIG. 1B).

The level shifter circuitry 108 may consume significant area and power, thereby decreasing the benefits of a digital regulator 100. Even if no level shifter circuit 108 is used or if the level shifter circuit 108 is implemented in an area and space efficient manner, a drawback of the digital regulator 100 is that the driver stage 120 comprising the N slices 103 typically exhibits a relatively strong PVT (Process, Voltage, Temperature) dependence. As a result of this, the output voltage 112 of the digital regulator 100 may exhibit a relatively strong ripple, especially for low load conditions.

Figure 1C:
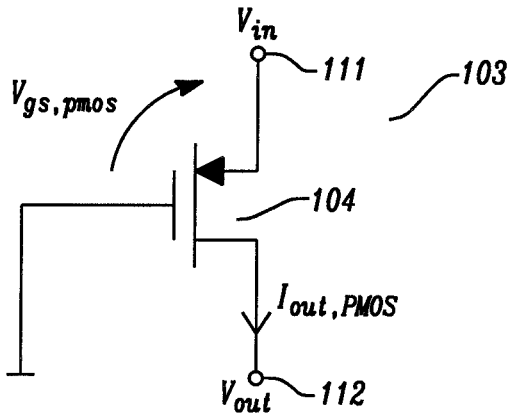
FIG. 1C shows an example driver slice for a digital voltage regulator.
Figure 1D:
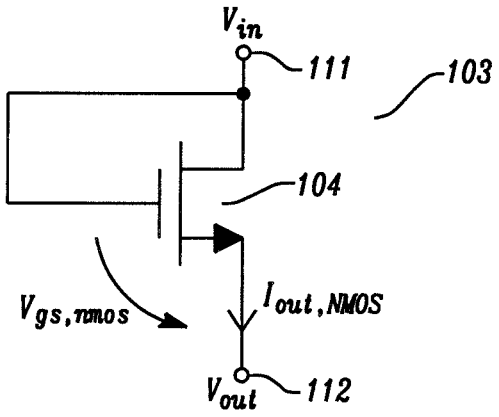
FIG. 1D shows an example driver slice for a digital voltage regulator.

FIGS. 1C and 1D illustrate the dependence of a driver slice 103 with respect to PVT. FIG. 1C shows the use of a PMOS (p-type metal oxide semiconductor (MOS)) transistor, and FIG. 1D shows the use of a NMOS (n-type MOS) transistor as a pass switch or pass transistor 104. The output current component of the pass switches 104 is given by $$I_{out,PMOS} \sim \mu_{PMOS} C_{OX}(-V_{gs,pmos}) = \mu_{PMOS} C_{OX}(V_{in})$$

$$I_{out,NMOS} \sim \mu_{NMOS} C_{OX}(V_{gs,nmos}) = \mu_{NMOS} C_{OX}(V_{in} - V_{out})$$

$C_{OX}$ is the gate oxide capacitance per unit area and $\mu$ is the charge-carrier effective mobility of the MOS transistor 104. These parameters are dependent on PVT and by consequence the output current components of the different slices 103 are dependent on PVT. This will lead to an output voltage ripple at the output node of the regulator 100, because the output current component which is provided by the different slices 103 is different for the different slices 103.

Figure 2A:
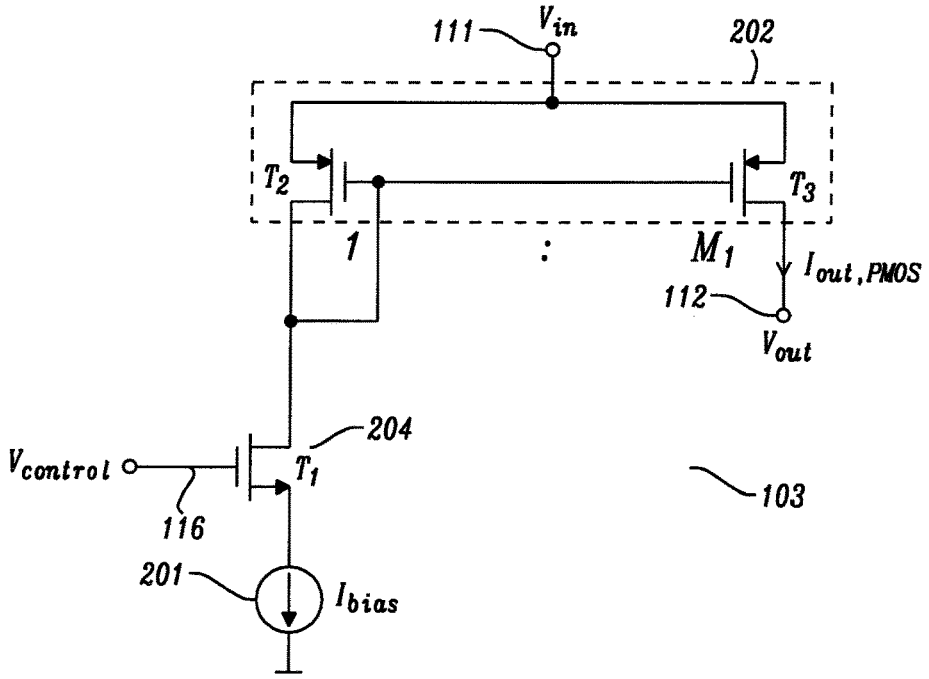
FIG. 2A shows an example PMOS type driver slice.
Figure 2B:
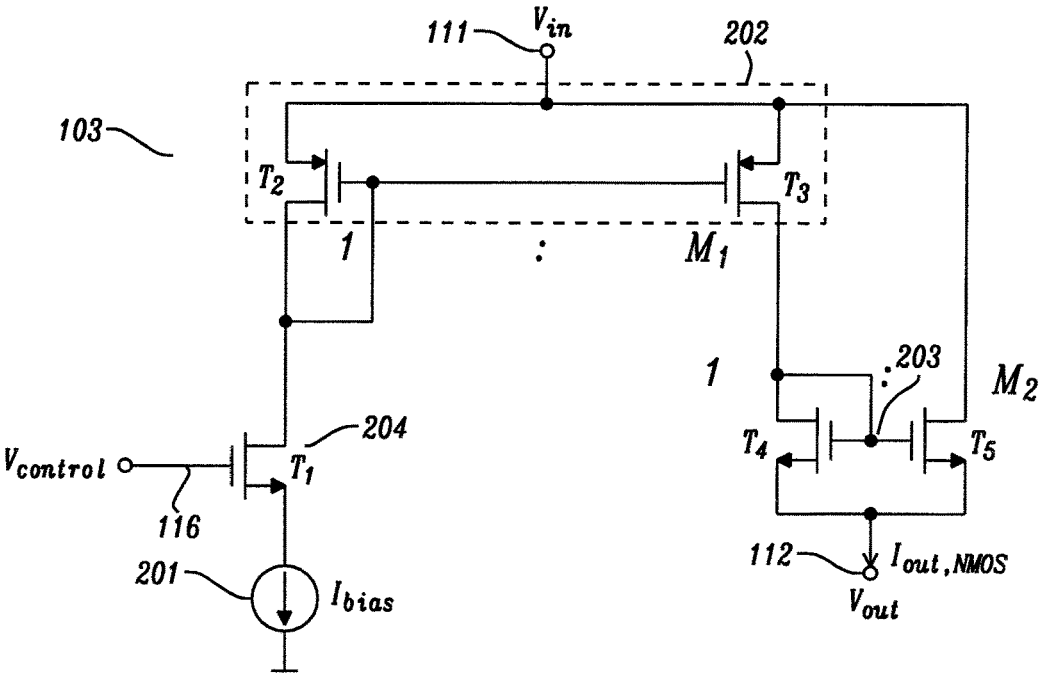
FIG. 2B shows an example NMOS type driver slice.

In the following, circuitry is described for reducing the ripple of the output voltage 112 of a digital regulator 100. FIGS. 2A and 2B show modified driver slices 103 for a PMOS and for a NMOS implementation, respectively. The modified driver slices 103 may be referred to as a Constant Gain Driver (CGD) slice 103. The PMOS CGD 103 of FIG. 2A is implemented using three transistors T1-T3 and the current source $I_{bias}$. The transistor T1 204 acts as a switch which connects the $I_{bias}$ current source 201 to the current mirror T2, T3 202. The mirror ratio of T2, T3 is 1:$M_1$. This mirror ratio is substantially independent of PVT variations, notably if T3 at the output of the current mirror 202 is operated in saturation and if channel length modulation may be neglected.

The output current component $I_{out,PMOS}$ which is provided by T3 and which is set using the control signal 116 is given by:

$$I_{out,PMOS} = M_1 \times I_{bias}$$

For activating a driver slice 103 (indicated by the control signal 116) a control voltage $V_{control}$ (e.g. VDD 118) may be applied to the gate of T1 204.

For the NMOS driver slice 103 of FIG. 2B two additional transistors T4, T5, forming another current mirror 203, may be used to provide an output current component $I_{out,NMOS}$, which is given by $$I_{out,NMOS} = M_1 \times M_2 \times I_{bias} + M_1 \times I_{bias}$$

Hence, a PVT independent output current component may be provided by the driver slices 103 shown in FIGS. 2A and 2B. Another advantage of the driver slices 103 of FIGS. 2A and 2B is the built-in level shifter function. Hence, no additional level shifter circuitry 108 is required for situations where $V_{in}$>VDD.

Hence, the driver slices 103 may be implemented as current sources, wherein each driver slice 103 provides a constant output current component. By doing this, the ripple of the output voltage 112 may be reduced. As a result of using a current source for a driver slice 103, the output current provided by the driver slice 103 is substantially independent of the difference between the input voltage 111 and the output voltage 112.

Figure 3:
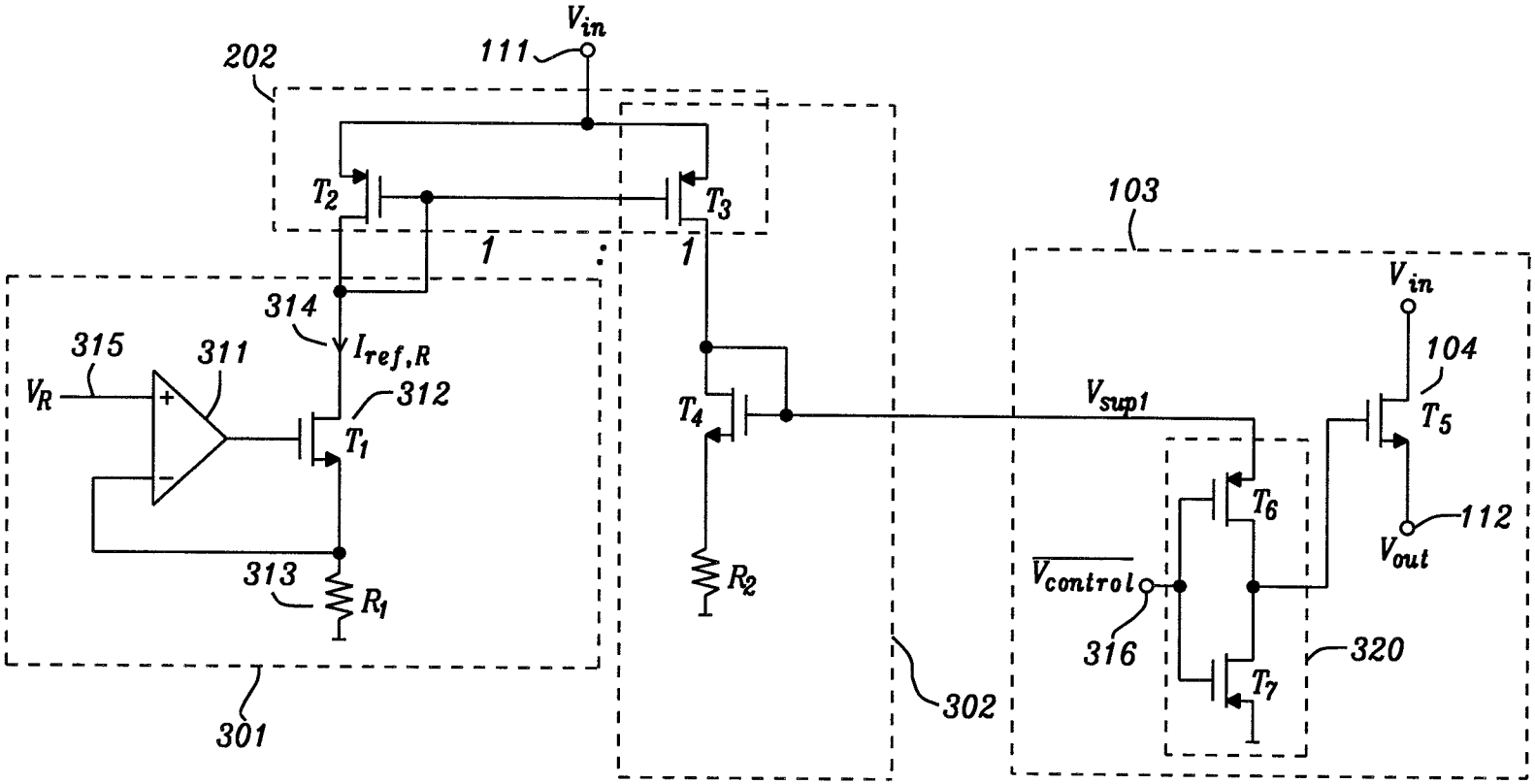
FIG. 3 shows an example driver stage with a combined reference current source.

In order to reduce the power consumption and the area of the N CGD slices 103, a global driver supply generation approach may be implemented as illustrated in FIG. 3. In this approach a reference current $I_{ref,R}$ 314 may be generated e.g. by an operational amplifier 311 regulating a fixed target voltage $V_R$ 315 across the reference resistance $R_1$ 313 using the reference transistor 312. The reference current 314 is then defined by $I_{ref,R} = V_R/R_1$. This reference current 314 is mirrored by the current mirror $T_2$, $T_3$ 202 to the intermediate resistor $R_2$ through the drive transistor $T_4$. The voltage across $R_2$ is given by the resistor ratio $R_2/R_1 \times V_R$ and is independent of PVT (notably if $T_3$ is in saturation and if the channel length modulation of $T_3$ may be neglected).

The drive transistor $T_4$ may be the same NMOS transistor as the pass transistor $T_5$ 104, wherein $T_4$ generates the gate voltage $V_{sup1}$ (also referred to herein as the first drive voltage) for $T_5$, wherein the gate voltage $V_{sup1}$ is defined by the reference current $I_{ref,R}$ 314. The driver slice transistor or pass transistor $T_5$ 104 is connected to the gate of $T_4$ via an inverter $T_6$, $T_7$ (referred to herein as activation circuitry 320) that is controlled using the inverted $V_{control}$ control signal 316. Hence, the transistors $T_4$ and $T_5$ form a current mirror that may be activated or deactivated using the control signal 116 or the inverted control signal 316. The reference current generator 301 for generating the reference current $I_{ref,R}$ 314 and/or the driver supply generator 302 may be provided only once for N different driver slices 103. By doing this, the power consumption and the area of the regulator 100 may be reduced.

Figure 4:
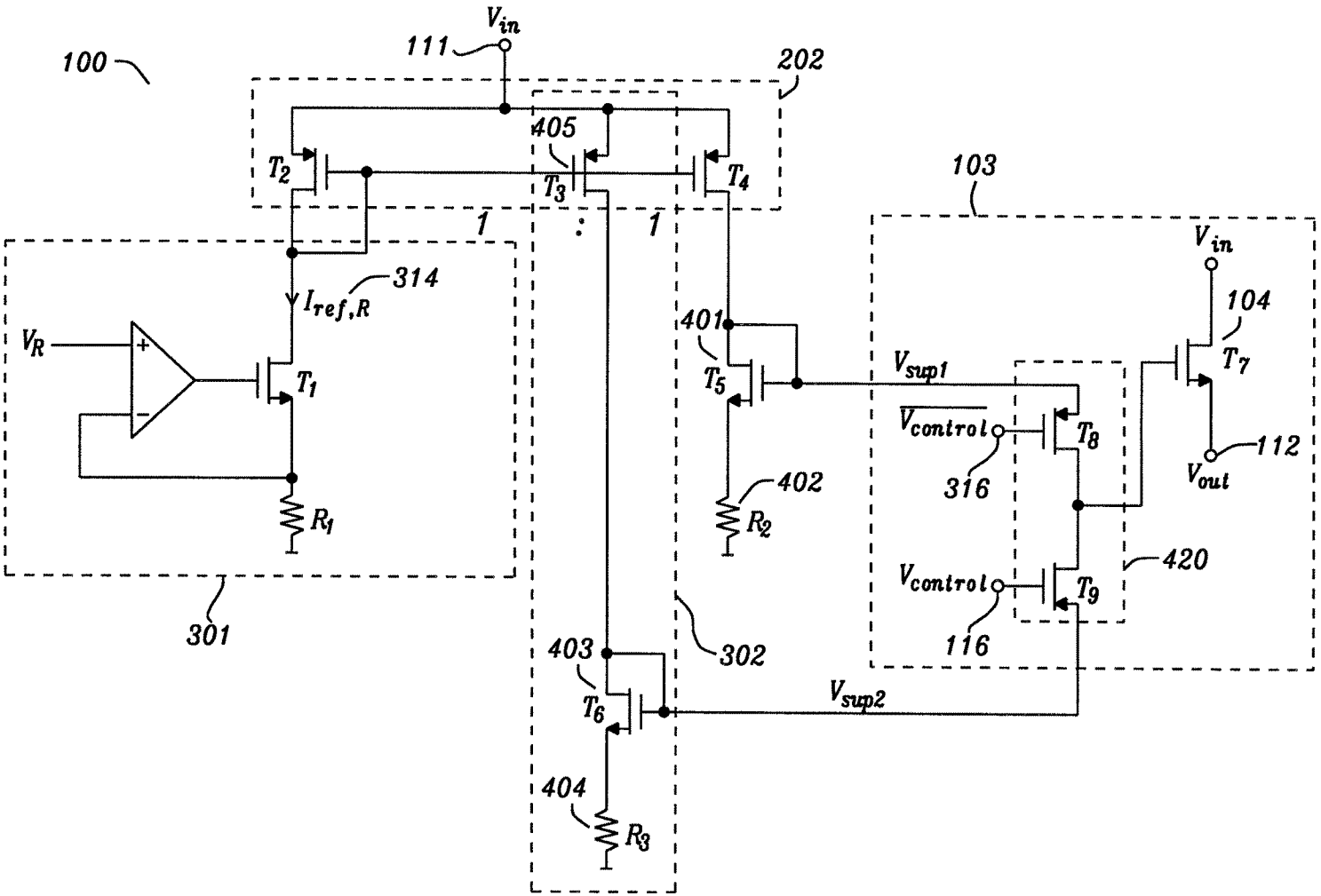
FIG. 4 shows example clamping circuitry.

In order to improve the load transient response of a digital regulator 100, a clamp enhancement technique may be used, as illustrated in FIG. 4. The digital regulator 100 makes use of the reference current generator 301 and the driver supply generator 302 shown in FIG. 3. The clamp enhancement is implemented using the transistors $T_3$, $T_6$ and the second intermediate resistor $R_3$ 404, which are operated in the same way as the transistors $T_4$, $T_5$ and the intermediate resistor $R_2$ 402. The only difference is the sizing of the second intermediate resistor $R_3$ 404. For $R_3$<$R_2$ the voltage $V_{sup2}$ (referred to herein as the second drive voltage) which is provided at the gate of the second drive transistor $T_6$ 403 is lower than the voltage $V_{sup1}$ which is provided at the gate of drive transistor $T_5$ 401.

The pass transistor $T_7$ 104 of a selected (i.e. active) driver slice 103 is coupled to the voltage $V_{sup1}$ via the transistor $T_8$ of the activation circuitry 420, which is controlled using the inverted $V_{control}$ signal 316, thereby contributing to the desired output voltage $V_{out}$ 112. On the other hand, the gate of the pass switch $T_7$ 104 of a deselected (i.e. inactive) driver slice 103 is not connected to the reference potential VSS 318 (as is the case in FIG. 3) but to the voltage $V_{sup2}$ (using the transistor $T_9$ of the activation circuitry 420, which is controlled using the control signal 116).

In case of a fast current ramp at the output node of the regulator 100, the output voltage $V_{out}$ 112 typically drops rapidly. If the output voltage $V_{out}$ 112 drops below $V_{out}<V_{sup2}-V_{th,T7}$ (wherein $V_{th,T7}$ is the threshold voltage of the pass transistor $T_7$ 104, all the deselected slices 103, i.e. all the closed pass transistors 104, will start to conduct current almost instantaneously and thereby prevent the output voltage $V_{out}$ 112 from dropping further. Hence, a clamp function subject to load transients, notably subject to an increase of the load 107, may be provided.

The second drive voltage $V_{sup2}$ is typically smaller than the first drive voltage $V_{sup1}$. Furthermore, the first drive voltage $V_{sup1}$ may be smaller than the control supply voltage VDD 118.

As such, a digital voltage regulator 100 configured to regulate an output voltage 112 at an output node based on an input voltage 111 is described in the present document. The voltage regulator 100 may be a digital LDO. The input voltage 111 may be provided by an input power supply (e.g. by a battery). The regulator 100 comprises a driver stage 120 comprising N driver slices 103, with N>1 (typically N=10, 50, 100, or more). Each of the N driver slices 103 can be activated or deactivated individually. In other words, the number n of activated driver slices 103 may be varied freely between 1 and N. By doing this, the output current that is provided to the output node of the regulator 100 may be varied, notably in order to regulate the output voltage 112 in accordance to a reference voltage 114.

A driver slice 103, typically each of the N driver slices 103, comprises a current source configured to provide an output current component to the output node, if the driver slice 103 is activated. The output current component provided by a driver slice 103 may be drawn from the input power supply. As such, one or more of the N driver slices 103 may provide an output current component each, thereby contributing to the overall output current provided by the voltage regulator 100 at the output node. By using a current source for providing the output current component of a driver slice 103 a stable output current component may be provided, which is substantially independent of PVT.

Furthermore, the regulator 100 comprises a control unit 102 which is configured to activate a number n of the N driver slices 103, based on a deviation of a feedback voltage 113 from a reference voltage 114, wherein the feedback voltage 113 is dependent on the output voltage 112. The feedback voltage 113 may be proportional to the output voltage 112. Using a comparator 101, the feedback voltage 113 may be compared to the (typically constant) reference voltage 114. The comparator signal 115 at the output of the comparator 101 may indicate whether the feedback voltage 113 is higher or lower than the reference voltage 114. The control unit 102 may determine the number n of active driver slices 103 based on the comparator signal 115. In particular, the control unit 102 may increase or decrease the number n based on the comparator signal 115 (e.g. increase the number n (e.g. by one), if the feedback voltage 113 is lower than the reference voltage 114 and/or decrease the number n (e.g. by one), if the feedback voltage 113 is greater than the reference voltage 114). The comparison of the feedback voltage 113 and the reference voltage 114 and/or the update of the number n of active driver slices 103 may be performed repeatedly or periodically (at an update frequency of e.g. 100 kHz or more).

The use of driver slices 103 which comprise current sources for generating the respective output current components provides a voltage regulator 100 with a reduced ripple of the output voltage 112.

The voltage regulator 100 may comprise a reference current source 201, 301 which is configured to provide a reference current 314. The output current component of a driver slice 103 may then be generated based on the reference current 314, thereby providing stable output current components (which a substantially independent of PVT).

Each of the driver slices 103 may comprise its own reference current source 201, 301. On the other hand, at least some of the N driver slices 103 may make use of the same reference current source 201, 301. In other words, the output current component of at least some of the N driver slices 103 may be generated from the reference current 314 provided by a joint reference current source 201, 301. In particular, the regulator 100 may comprise only a single reference current source 201, 301 for the N driver slices 103, i.e. for providing the output current components of the N driver slices 103. By making use of a reference current source 201, 301 which is shared at least partially among the driver slices 103 of the regulator 100, an area and power efficient regulator 100 may be provided.

The regulator 100 may comprises a PMOS current mirror 202 which is configured to mirror the reference current 314 towards the output node for providing the output current component of one or more driver slices 103. The current at the input of the PMOS current mirror 202 may correspond to the reference current 314. The current at the output of the PMOS current mirror 202 may be used as the output current component of a PMOS type driver slice 103. The PMOS current mirror 202 may comprise a first PMOS transistor at the input (which is typically arranged as a diode) and a second PMOS transistor at the output. The sources of the PMOS transistors may be coupled to the input voltage 111 or to a control supply voltage VDD 118.

The regulator 100 may comprise a PMOS current mirror 202 for multiple driver slices 103. In particular, the regulator 100 may comprise a single PMOS current mirror 202 for deriving the output current component of at least some (e.g. for all) of the N driver slices 103 based on the reference current 314. As a result of this, an area and power efficient regulator 100 may be provided.

The voltage regulator 100 may comprise an NMOS current mirror 203 which is configured to mirror a current at the output of the PMOS current mirror 202 towards the output node for providing the output current component of one or more driver slices 103. The NMOS current mirror 203 may comprise a first NMOS transistor at the input and a second NMOS transistor at the output of the NMOS current mirror 203. The first NMOS transistor of the NMOS current mirror 203 may be arranged in series with the second PMOS transistor of the PMOS current mirror 202. The first NMOS transistor may be arranged as a diode.

The source of at least one of the NMOS transistors of the NMOS current mirror 203 (notably the source of the second NMOS transistor at the output of the NMOS current mirror 203) may be coupled to the output node of the regulator 100 for providing the output current component of at least one of the driver slices 103. Hence, an NMOS type driver slice 103 and/or NMOS type voltage regulator 100 may be provided.

The drain of at least one of the NMOS transistors of the NMOS current mirror 203 (notably the drain of the second NMOS transistor at the output of the NMOS current mirror 203) may be coupled to the input voltage 111. As such, the second NMOS transistor may form a pass switch or a pass transistor 104 of a driver slice 103.

The PMOS current mirror 202 and/or the NMOS current mirror 203 may each exhibit a mirror ratio for amplifying the reference current 314. By doing this, the power efficiency of the regulator 100 may be increased further.

A reference current source 201, 301 may comprise a reference current transistor 312 and a reference current resistor 313, which are arranged in series, such that the reference current 314 which is provided by the reference current source 201, 301 flows through the reference current transistor 312 and through the reference current resistor 313. The reference current transistor 312 may be controlled such that a voltage drop at the reference current resistor 313 corresponds to a target voltage 315. In particular, a reference current source 201, 301 may comprise an operational amplifier 311 configured to control the reference current transistor 312 based on the target voltage 315 and based on the voltage drop at the reference current resistor 313. As a result of this, a stable reference current 314 may be provided, which is substantially independent of PVT.

As indicated above, the control unit 102 may be configured to provide a control signal 116 indicating whether a driver slice 103 is to be activated or not. In particular, the control signal 116 may indicate for each of the N driver slices 103 whether the driver slice 103 is to be active or inactive. An active driver slice 103 provides an output current component (greater zero). On the other hand, an inactive driver slice 103 does not provide a current to the output node of the regulator 100.

A driver slice 103 may comprise a control switch 204 which is configured to couple the reference current source 201, 301 to the input of the PMOS current mirror 202 for activating the driver slice 103 or to decouple the reference current source 201, 301 from the input of the PMOS current mirror 202 for deactivating the driver slice 103. The control switch 204 may be controlled based on the control signal 116. By doing this, the different driver slices 103 may be controlled in an individual and independent manner.

The regulator 100 may comprise a drive transistor 401 which is arranged in series with the output of the PMOS current mirror 202, such that a mirrored reference current (mirrored by the PMOS current mirror 202) flows through the drive transistor 401. The drive transistor 401 may correspond to the first NMOS transistor of an NMOS current mirror 203. The drive transistor 401 may be arranged in series with the second PMOS transistor of the PMOS current mirror 202.

A gate of the drive transistor 401 may be coupled with a gate of a pass transistor 104 of a driver slice 103 via activation circuitry 320, 420. As such, the drive transistor 401 (which may be arranged as a diode by coupling the gate with the drain of the drive transistor 401) may form an NMOS current mirror 203 with the pass transistor 104 (which may be an NMOS transistor).

Each of the N driver slices 103 may comprises a pass transistor 104, wherein the gates of the N pass transistors 104 may be coupled to the gate of the (single) drive transistor 401 via N activation circuitries 320, 420 for the N driver slices 103. As such, the different driver slices 103 may be driven using a single reference current source 301 and a single PMOS current mirror 202.

The activation circuitry 320, 420 of a driver slice 103 may be controlled based on the control signal 116 (notably based on the bit of the control signal 116, which is assigned to the particular driver slice 103). The control signal 116 may comprise N bits for the N driver slices 103. The activation circuitries 320, 420 of the N driver slices 103 may be controlled based on the respective bits of the control signal 116.

The regulator 100 may comprise an intermediate resistor $R_2$ 402 which is arranged between the drive transistor 401 and a reference potential 318 (e.g. ground or VSS) of the regulator 100, such that the mirrored reference current (provided by the PMOS current mirror 202) flows through the intermediate resistor 402. As such, a first drive voltage $V_{sup1}$ corresponding to the voltage drop at the intermediate resistor $R_2$ 402 and the drive transistor 401 may be provided.

This first drive voltage Vsup1 may be used to control one or more of the N driver slices 103. The activation circuitry 320, 420 of a driver slice 103 may be configured to couple the gate of the pass transistor 104 of the driver slice 103 with or to decouple the gate of the pass transistor 104 from the first drive voltage $V_{sup1}$. By doing this, the respective driver slice 103 may be activated or deactivated, respectively.

The regulator 100 may comprise a second PMOS current mirror 405 providing a second mirrored reference current from the reference current 314. The second PMOS current mirror 405 may share the first PMOS transistor with the PMOS current mirror 202. On the other hand, the second PMOS current mirror 405 may have a different second PMOS transistor at the output of the second PMOS current mirror 405. The PMOS current mirror 202 and the second PMOS current mirror 405 may have the same mirror ratio.

The second PMOS current mirror 405 may be used to derive a second drive voltage $V_{sup2}$ from the reference current 314, notably such that the first drive voltage $V_{sup1}$ is greater than the second drive voltage $V_{sup2}$. Such a second drive voltage $V_{sup2}$ may be used to provide a clamping mode, for increasing the transient performance of the regulator 100.

The regulator 100 may comprise a second drive transistor 403 and a second intermediate resistor 404 which are arranged in series. The second intermediate resistor 404 is arranged between the second drive transistor 403 and the reference potential 318, such that the second mirrored reference current flows through the second drive transistor 403 and through the second intermediate resistor 404. As such, a second drive voltage $V_{sup2}$ corresponding to the voltage drop at the second intermediate resistor 404 and the second drive transistor 403 may be provided.

The second intermediate resistor 404 may have a smaller resistance value than the intermediate resistor 402, thereby setting the second drive voltage $V_{sup2}$ to be smaller than the first drive voltage $V_{sup1}$. Hence, the drive voltages may be determined in an efficient manner.

The activation circuitry 320, 420 of a driver slice 103 may be configured to couple the gate of the pass transistor 104 with or to decouple the gate of the pass transistor 104 from the second drive voltage $V_{sup2}$. In particular, the gate of the pass transistor 104 may be coupled to the second drive voltage $V_{sup2}$ for opening the pass transistor 104 (e.g. a NMOS transistor). On the other hand, the gate of the pass transistor 104 may be coupled to the first drive voltage $V_{sup1}$ for closing the pass transistor 104 (to provide the output current component). As such, the activation circuitry 320, 420 of a driver slice 103 may be configured to activate or to deactivate the driver slice 103 in a reliable manner.

Furthermore, the provision of a second drive voltage $V_{sup2}$ provides a clamping mode. In particular, the second drive voltage $V_{sup2}$ may be set (e.g. by setting the resistance value of the second intermediate resistor 404) such that the closing of the pass transistor 104 of a driver slice 103 is triggered automatically (regardless the control signal 116), if the output voltage 112 falls below a pre-determined trigger voltage. As a result of this, an additional output current component is provided to the output node in case of a drop of the output voltage 112, thereby working against the drop of the output voltage 112. Hence, the reaction speed of the regulator 100, subject to load transients (notably subject to an increase of the load 107) may be increased.

Hence, the regulator 100 may comprise drive circuitry 301, 302, 202, 405, 401, 402, 403, 404 which is configured to generate a first drive voltage $V_{sup1}$ and a second drive voltage $V_{sup2}$ based on the reference current 314 provided by a (possibly single) reference current source 201, 301.

Furthermore, the regulator 100 may comprise activation circuitry 320, 420 which is configured to couple a pass transistor 104 of a driver slice 103 with the first drive voltage $V_{sup1}$ to activate the driver slice 103 or to couple the pass transistor 104 of the driver slice 103 with the second drive voltage $V_{sup2}$ to deactivate the driver slice 103. Such activation circuitry 320, 402 may be provided for each of the N driver slices 103.

As indicated above, the first drive voltage $V_{sup1}$ may be greater than the second drive voltage $V_{sup2}$ which may be greater than the reference potential 318 of the regulator 100. Furthermore, the first drive voltage $V_{sup1}$ may be smaller than the input voltage 111 or the control supply voltage 118.

The second drive voltage $V_{sup2}$ may be dependent on the threshold voltage of the pass transistor 104 of a driver slice 103 and dependent on a trigger voltage. The second drive voltage $V_{sup2}$ may be such that the pass transistor 104 of a deactivated driver slice 103 is closed (regardless the control signal 116) to provide the output current component to the output node, if the output voltage 112 falls to or below the trigger voltage. Hence, in case of a drop of the output voltage 112, all the pass transistors 104 of the N driver slices 103 may be closed automatically, independent from the regulation loop of the regulator 100 and/or independent from the control signal 116, thereby increasing the reaction speed of the regulator 100 subject to a sudden increase of the load 107.

In other words, the regulator 100 may comprise clamping circuitry which is configured to bypass the control unit 102 for activating one or more of the N driver slices 103, subject to a drop of the output voltage 112 at or below the trigger voltage.

Figure 5:
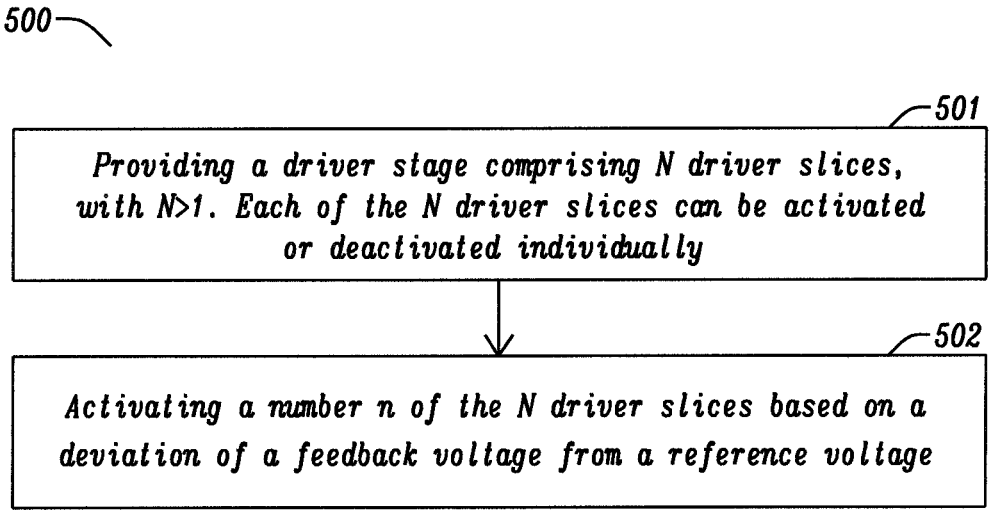
FIG. 5 shows a flow chart of an example method for regulating an output voltage.

FIG. 5 shows a flow chart of an example method 500 for regulating an output voltage 112 at an output node based on an input voltage 111. The method 500 comprises providing 501 a driver stage 120 comprising N driver slices 103, with N>1. Each of the N driver slices 103 can be activated or deactivated individually. Each of the N driver slices 103 may comprise a current source configured to provide an output current component to the output node, when the driver slice 103 is activated. The method 500 further comprises activating 502 a number n of the N driver slices 103, based on a deviation of a feedback voltage 113 from a reference voltage 114, wherein the feedback voltage 113 is dependent on the output voltage 112. In other words, the number n of activated driver slices 103 may be determined (repeatedly or periodically) based on the deviation of the feedback voltage 113 from the reference voltage 114.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A digital voltage regulator configured to regulate an output voltage at an output node based on an input voltage; wherein the regulator comprises a driver stage comprising N driver slices, with N>1; wherein each of the N driver slices can be activated or deactivated individually; wherein a driver slice comprises a current source configured to provide an output current component to the output node, if the driver slice is activated;

a control unit configured to activate a number n of the N driver slices, based on a deviation of a feedback voltage from a reference voltage; wherein the feedback voltage is dependent on the output voltage; and clamping circuitry which is configured to bypass the control unit for activating one or more of the N driver slices, subject to a drop of the output voltage at or below a trigger voltage.

2. The digital voltage regulator according to claim 1, wherein the voltage regulator comprises a reference current source configured to provide a reference current; and a PMOS current mirror configured to mirror the reference current towards the output node for providing the output current component of one or more driver slices.

3. The digital voltage regulator according to claim 2, wherein the voltage regulator comprises an NMOS current mirror configured to mirror a current at the output of the PMOS current mirror towards the output node for providing the output current component of one or more driver slices.

4. The digital voltage regulator according to claim 2, wherein the reference current source comprises a reference current transistor and a reference current resistor, which are arranged in series, such that the reference current flows through the reference current transistor and through the reference current resistor; and the reference current transistor is controlled such that a voltage drop at the reference current resistor corresponds to a target voltage.

5. The digital voltage regulator according to claim 4, wherein the reference current source comprises an operational amplifier configured to control the reference current transistor based on the target voltage and based on the voltage drop at the reference current resistor.

6. The digital voltage regulator according to claim 2, wherein the control unit is configured to provide a control signal indicating whether a driver slice is to be activated or not;

a driver slice comprises a control switch configured to couple the reference current source to the input of the PMOS current mirror for activating the driver slice; and the control switch is controlled based on the control signal.

7. The digital voltage regulator according to claim 2, wherein the regulator comprises a single reference current source for the N driver slices.

8. The digital voltage regulator according to claim 7, wherein the regulator comprises a single PMOS current mirror for deriving the output current component of each of the N driver slices based on the reference current.

9. The digital voltage regulator according to claim 2, wherein the regulator comprises a drive transistor which is arranged in series with the output of the PMOS current mirror, such that a mirrored reference current flows through the drive transistor;

a gate of the drive transistor is coupled with a gate of a pass transistor of a driver slice via activation circuitry; and the control unit is configured to provide a control signal indicating whether the driver slice is to be activated or not; and the activation circuitry is controlled based on the control signal.

10. The digital voltage regulator according claim 9, wherein the regulator comprises an intermediate resistor which is arranged between the drive transistor and a reference potential of the regulator, such that the mirrored reference current flows through the intermediate resistor; and the activation circuitry is configured to couple the gate of the pass transistor with or to decouple the gate of the pass transistor from a first drive voltage corresponding to a voltage drop at the intermediate resistor and the drive transistor.

11. The digital voltage regulator according claim 10, wherein the regulator comprises a second PMOS current mirror providing a second mirrored reference current from the reference current; and the regulator comprises a second drive transistor and a second intermediate resistor which are arranged in series, with the second intermediate resistor being arranged between the second drive transistor and the reference potential, such that the second mirrored reference current flows through the second drive transistor and the second intermediate resistor;

the second intermediate resistor has a smaller resistance value than the intermediate resistor; and the activation circuitry is configured to couple the gate of the pass transistor with or to decouple the gate of the pass transistor from a second drive voltage corresponding to a voltage drop at the second intermediate resistor and the second drive transistor.

12. A digital voltage regulator configured to regulate an output voltage at an output node based on an input voltage, wherein the regulator comprises, a driver stage comprising N driver slices, with N>1: wherein each of the N driver slices can be activated or deactivated individually; wherein a driver slice comprises a current source configured to provide an output current component to the output node, if the driver slice is activated;

a control unit configured to activate a number n of the N driver slices, based on a deviation of a feedback voltage from a reference voltage; wherein the feedback voltage is dependent on the output voltage;

drive circuitry configured to generate a first drive voltage and a second drive voltage based on a reference current provided by a reference current source; and activation circuitry which is configured to couple a pass transistor of a driver slice with the first drive voltage to activate the driver slice or to couple the pass transistor of the driver slice with the second drive voltage to deactivate the driver slice; wherein the first drive voltage is greater than the second drive voltage.

13. The digital voltage regulator according claim 12, wherein the second drive voltage is dependent on a threshold voltage of the pass transistor and a trigger voltage; and the second drive voltage is such that the pass transistor of the deactivated driver slice starts conducting and provides the output current component to the output node, if the output voltage falls to or below the trigger voltage.

14. A method for regulating an output voltage at an output node based on an input voltage of a voltage regulator; wherein the method comprises the steps of:

providing a driver stage comprising N driver slices, with N>1; wherein each of the N driver slices can be activated or deactivated individually; wherein a driver slice comprises a current source to provide an output current component to the output node, if the driver slice is activated; and activating a number n of the N driver slices, based on a deviation of a feedback voltage from a reference voltage; wherein the feedback voltage is dependent on the output voltage, and wherein the regulator comprises clamping circuitry to bypass the control unit for activating one or more of the N driver slices, subject to a drop of the output voltage at or below a trigger voltage.

15. The method according to claim 14, wherein the voltage regulator comprises a reference current source to provide a reference current; and a PMOS current mirror to mirror the reference current towards the output node for providing the output current component of one or more driver slices.

16. The method according to claim 15, wherein the voltage regulator comprises an NMOS current mirror to mirror a current at the output of the PMOS current mirror towards the output node for providing the output current component of one or more driver slices.

17. The method according to claim 15, wherein the reference current source comprises a reference current transistor and a reference current resistor, which are arranged in series, such that the reference current flows through the reference current transistor and through the reference current resistor; and the reference current transistor is controlled such that a voltage drop at the reference current resistor corresponds to a target voltage.

18. The method according to claim 17, wherein the reference current source comprises an operational amplifier to control the reference current transistor based on the target voltage and based on the voltage drop at the reference current resistor.

19. The method according to claim 15, wherein the control unit provides a control signal indicating whether a driver slice is to be activated or not;

a driver slice comprises a control switch to couple the reference current source to the input of the PMOS current mirror for activating the driver slice; and the control switch is controlled based on the control signal.

20. The method according to claim 15, wherein the regulator comprises a single reference current source for the N driver slices.

21. The method according to claim 20, wherein the regulator comprises a single PMOS current mirror for deriving the output current component of each of the N driver slices based on the reference current.

22. The method according to claim 15, wherein the regulator comprises a drive transistor which is arranged in series with the output of the PMOS current mirror, such that a mirrored reference current flows through the drive transistor;

a gate of the drive transistor is coupled with a gate of a pass transistor of a driver slice via activation circuitry; and the control unit provides a control signal indicating whether the driver slice is to be activated or not; and the activation circuitry is controlled based on the control signal.

23. The method according claim 22, wherein the regulator comprises an intermediate resistor which is arranged between the drive transistor and a reference potential of the regulator, such that the mirrored reference current flows through the intermediate resistor; and the activation circuitry couples the gate of the pass transistor with or to decouple the gate of the pass transistor from a first drive voltage corresponding to a voltage drop at the intermediate resistor and the drive transistor.

24. The method according claim 23, wherein the regulator comprises a second PMOS current mirror providing a second mirrored reference current from the reference current; and the regulator comprises a second drive transistor and a second intermediate resistor which are arranged in series, with the second intermediate resistor being arranged between the second drive transistor and the reference potential, such that the second mirrored reference current flows through the second drive transistor and the second intermediate resistor;

the second intermediate resistor has a smaller resistance value than the intermediate resistor; and the activation circuitry couples the gate of the pass transistor with or to decouple the gate of the pass transistor from a second drive voltage corresponding to a voltage drop at the second intermediate resistor and the second drive transistor.

25. The method according to claim 14, wherein the regulator comprises, drive circuitry to generate a first drive voltage and a second drive voltage based on a reference current provided by a reference current source; and activation circuitry to couple a pass transistor of a driver slice with the first drive voltage to activate the driver slice or to couple the pass transistor of the driver slice with the second drive voltage to deactivate the driver slice; wherein the first drive voltage is greater than the second drive voltage.

26. The method according claim 25, wherein the second drive voltage is dependent on a threshold voltage of the pass transistor and a trigger voltage; and the second drive voltage is such that the pass transistor of the deactivated driver slice starts conducting and provides the output current component to the output node, if the output voltage falls to or below the trigger voltage.

* * * * *